US007335834B2

(12) United States Patent
Gayama

(10) Patent No.: US 7,335,834 B2
(45) Date of Patent: Feb. 26, 2008

(54) MUSICAL COMPOSITION DATA CREATION DEVICE AND METHOD

(75) Inventor: Shinichi Gayama, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 360 days.

(21) Appl. No.: 10/535,990

(22) PCT Filed: Nov. 12, 2003

(86) PCT No.: PCT/JP03/14365

§ 371 (c)(1),
(2), (4) Date: Aug. 9, 2005

(87) PCT Pub. No.: WO2004/051622

PCT Pub. Date: Jun. 17, 2004

(65) Prior Publication Data

US 2006/0070510 A1 Apr. 6, 2006

(30) Foreign Application Priority Data

Nov. 29, 2002 (JP) ..... 2002-348313

(51) Int. Cl.
*G10H 1/38* (2006.01)
*G10H 7/00* (2006.01)
*G10H 5/00* (2006.01)

(52) U.S. Cl. ..... 84/613; 84/609; 84/637; 84/649; 84/669

(58) Field of Classification Search ..... 84/613, 84/609, 637, 649, 669
See application file for complete search history.

(56) References Cited

U.S. PATENT DOCUMENTS 4,019,417 A * 4/1977 Carlson ..... 84/618
4,197,777 A * 4/1980 Wheelwright et al. ..... 84/682
4,248,119 A * 2/1981 Yamada ..... 84/637
4,282,788 A * 8/1981 Yamaga et al. ..... 84/635
4,292,874 A * 10/1981 Jones et al. ..... 84/635
4,699,039 A * 10/1987 Oguri et al. ..... 84/622
4,951,544 A * 8/1990 Minamitaka ..... 84/613
5,056,401 A * 10/1991 Yamaguchi et al. ..... 84/635

(Continued)

FOREIGN PATENT DOCUMENTS

| | | |
|---|---|---|
| JP | 60-26091 | 2/1985 |
| JP | 5-173557 | 7/1993 |
| JP | 7-44163 | 2/1995 |
| JP | 10-319947 | 12/1998 |
| JP | 2002-91433 | 3/2002 |

OTHER PUBLICATIONS

European search report dated Mar. 22, 2006.
International Search Report dated Feb. 17, 2004, with translation of relevant portions.

*Primary Examiner*—Lincoln Donovan
*Assistant Examiner*—Christina Russell
(74) *Attorney, Agent, or Firm*—McGinn IP Law Group, PLLC

(57) ABSTRACT

An apparatus and a method for making music data each perform converting an input audio signal indicative of a music piece into a frequency signal indicative of magnitudes of frequency components at predetermined time intervals; extracting frequency components corresponding to tempered tones respectively at the predetermined time intervals from the frequency signal; detecting two chords each formed by a set of three frequency components as the first and second chord candidates, the three frequency components having a large total level of the frequency components corresponding to the extracted tones; and smoothing trains of the detected first and second chord candidates to produce music data.

12 Claims, 11 Drawing Sheets

U.S. PATENT DOCUMENTS 5,221,802 A * 6/1993 Konishi et al. ..... 84/637
5,403,966 A * 4/1995 Kawashima et al. ..... 84/613
5,440,736 A * 8/1995 Lawson, Jr. ..... 707/7
5,440,756 A * 8/1995 Larson ..... 704/278
5,486,647 A * 1/1996 Kay et al. ..... 84/635
5,563,361 A * 10/1996 Kondo et al. ..... 84/637
5,641,928 A * 6/1997 Tohgi et al. ..... 84/613
5,747,716 A * 5/1998 Matsumoto ..... 84/609
5,777,251 A * 7/1998 Hotta et al. ..... 84/609
5,852,252 A * 12/1998 Takano ..... 84/650
5,859,382 A * 1/1999 Funaki ..... 84/637
6,057,502 A * 5/2000 Fujishima ..... 84/637
6,252,152 B1 * 6/2001 Aoki et al. ..... 84/609
6,255,577 B1 * 7/2001 Imai ..... 84/609
6,506,969 B1 * 1/2003 Baron ..... 84/609
6,984,781 B2 * 1/2006 Mazzoni ..... 84/613
7,189,914 B2 * 3/2007 Mack ..... 84/613
2001/0045153 A1 * 11/2001 Alexander et al. ..... 84/609
2004/0144238 A1 * 7/2004 Gayama ..... 84/613
2004/0255759 A1 * 12/2004 Gayama ..... 84/613
2005/0109194 A1 * 5/2005 Gayama ..... 84/613

* cited by examiner

FIG.3

| | |
|---|---|
| A | 1.0 |
| A# | A × 1.059163 |
| B | A × 1.124622 |
| C | A × 1.189207 |
| C# | A × 1.259921 |
| D | A × 1.334840 |
| D# | A × 1.414214 |
| E | A × 1.498307 |
| F | A × 1.587401 |
| F# | A × 1.681793 |
| G | A × 1.781797 |
| G# | A × 1.887749 |
| A | A × 2.0 |

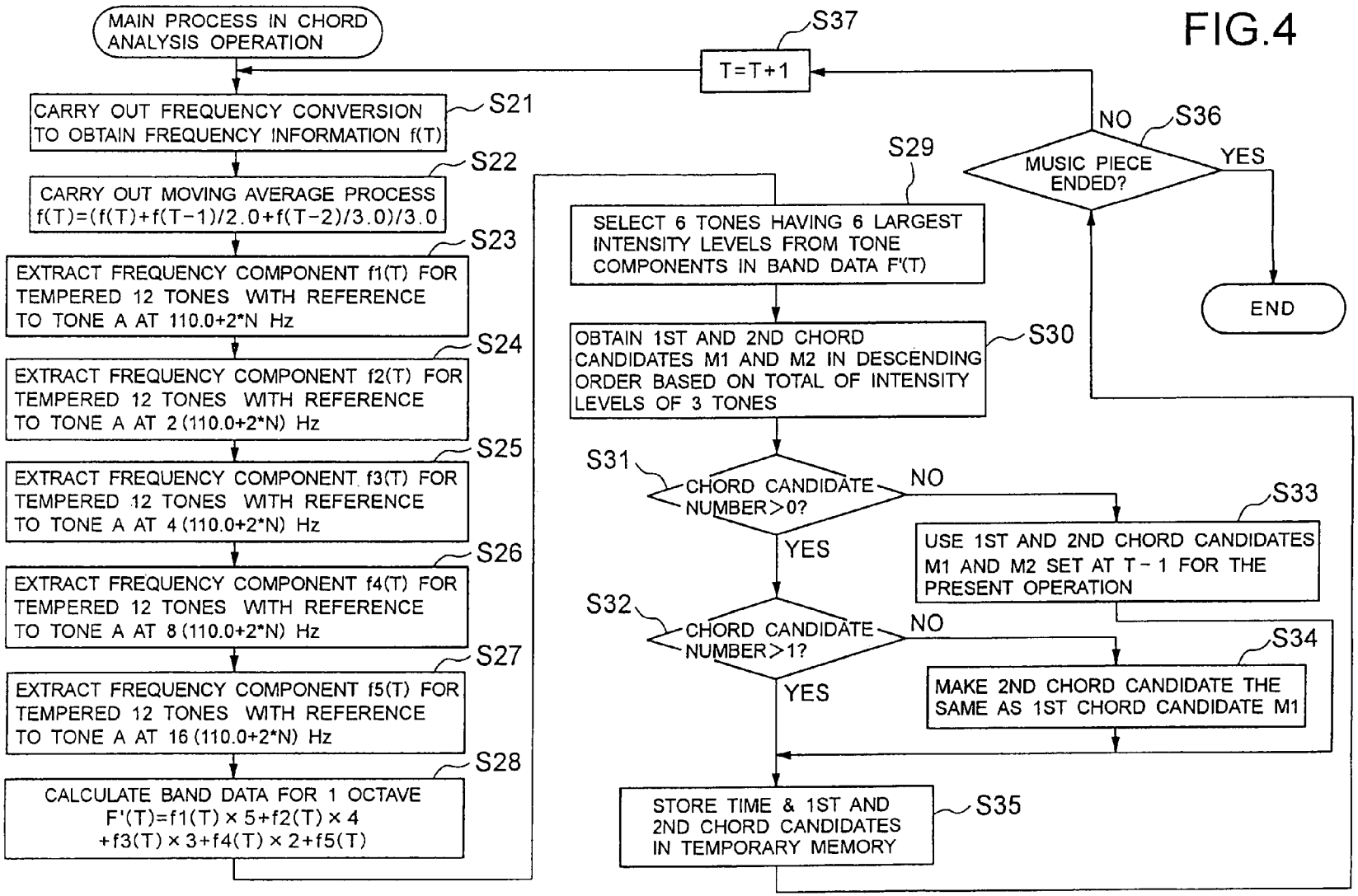
FIG.4
MAIN PROCESS IN CHORD ANALYSIS OPERATION
S21
CARRY OUT FREQUENCY CONVERSION TO OBTAIN FREQUENCY INFORMATION f(T)
S22
CARRY OUT MOVING AVERAGE PROCESS f(T)=(f(T)+f(T−1)/2.0+f(T−2)/3.0)/3.0
S23
EXTRACT FREQUENCY COMPONENT f1(T) FOR TEMPERED 12 TONES WITH REFERENCE TO TONE A AT 110.0+2*N Hz
S24
EXTRACT FREQUENCY COMPONENT f2(T) FOR TEMPERED 12 TONES WITH REFERENCE TO TONE A AT 2(110.0+2*N) Hz
S25
EXTRACT FREQUENCY COMPONENT f3(T) FOR TEMPERED 12 TONES WITH REFERENCE TO TONE A AT 4(110.0+2*N) Hz
S26
EXTRACT FREQUENCY COMPONENT f4(T) FOR TEMPERED 12 TONES WITH REFERENCE TO TONE A AT 8(110.0+2*N) Hz
S27
EXTRACT FREQUENCY COMPONENT f5(T) FOR TEMPERED 12 TONES WITH REFERENCE TO TONE A AT 16(110.0+2*N) Hz
S28
CALCULATE BAND DATA FOR 1 OCTAVE F'(T)=f1(T)×5+f2(T)×4 +f3(T)×3+f4(T)×2+f5(T)
S29
SELECT 6 TONES HAVING 6 LARGEST INTENSITY LEVELS FROM TONE COMPONENTS IN BAND DATA F'(T)
S30
OBTAIN 1ST AND 2ND CHORD CANDIDATES M1 AND M2 IN DESCENDING ORDER BASED ON TOTAL OF INTENSITY LEVELS OF 3 TONES
S31
CHORD CANDIDATE NUMBER>0?
NO
YES
S32
CHORD CANDIDATE NUMBER>1?
NO
YES
S33
USE 1ST AND 2ND CHORD CANDIDATES M1 AND M2 SET AT T−1 FOR THE PRESENT OPERATION
S34
MAKE 2ND CHORD CANDIDATE THE SAME AS 1ST CHORD CANDIDATE M1
S35
STORE TIME & 1ST AND 2ND CHORD CANDIDATES IN TEMPORARY MEMORY
S36
MUSIC PIECE ENDED?
NO
YES
END
S37
T=T+1

FIG.7

A+C+E+G(Am7)
→ A+C+E(Am) | C+E+G(C)

A+C+E♭+F#(Adim7)
→ A+C+E♭(Adim7 CANDIDATE) | C+E♭+F#(Cdim7 CANDIDATE)

A+C#+E+G(A7)
→ A+C#+E(A) | A+C#+G(A7 CANDIDATE) | C#+E+G(C#dim7 CANDIDATE)

A+C+E+G+B(Am7.9)
→ A+C+E(Am) | C+E+G(C) | E+G+B(Em)

FIG.8

TIME (4 BYTES) 1ST CHORD CANDIDATE (1 BYTE) 2ND CHORD CANDIDATE (1 BYTE)
TIME (4 BYTES) 1ST CHORD CANDIDATE (1 BYTE) 2ND CHORD CANDIDATE (1 BYTE)

⋮

TIME (4 BYTES) 1ST CHORD CANDIDATE (1 BYTE) 2ND CHORD CANDIDATE (1 BYTE)

FIG.9A

| FUNDAMENTAL TONE | |
|---|---|
| A | 0×00 |
| A# | 0×01 |
| B | 0×02 |
| C | 0×03 |
| C# | 0×04 |
| D | 0×05 |
| D# | 0×06 |
| E | 0×07 |
| F | 0×08 |
| F# | 0×09 |
| G | 0×0A |
| G# | 0×0B |

FIG.9B

| ATTRIBUTE | |
|---|---|
| MAJOR | 0×00 |
| MINOR | 0×02 |
| 7TH CANDIDATE | 0×01 |
| DIM 7TH CANDIDATE | 0×03 |

FIG.9C

ATTRIBUTE (LOWER 4 BITS) + FUNDAMENTAL TONE (LOWER 4 BITS)

FIG.14A

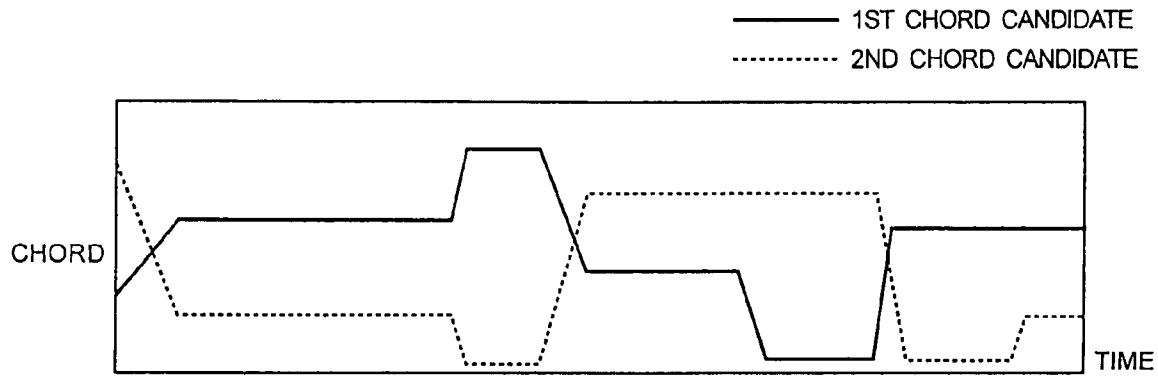

FIG.14B

| | | | | | |
|---|---|---|---|---|---|
| TRANSITION OF 1ST CHORD CANDIDATE | F<br>0×08<br>←TIME (T1(0)) | G<br>0×0A<br>T1(1) | D<br>0×05<br>T1(2) | B♭<br>0×01<br>T1(3) | F<br>0×08<br>T1(4) |

FIG.14C

| | | | | | | |
|---|---|---|---|---|---|---|
| TRANSITION OF 2ND CHORD CANDIDATE | F<br>0×03<br>←TIME (T2(0)) | B♭<br>0×01<br>T2(1) | F#m<br>0×29<br>T2(2) | B♭<br>0×01<br>T2(3) | C<br>0×03<br>T2(4) |

FIG.14D

IDENTIFICATION INFORMATION FOR MUSIC PIECES (FILE NAMES, ETC.) (512 BYTES)

NUMBER OF 1ST CHORD CANDIDATES (4 BYTES) T1(0) (4 BYTES) [0×08] T1(1) (4 BYTES) [0×0A] T1(2) (4 BYTES) [0×05] T1(3) (4 BYTES) [0×01] T1(4) (4 BYTES) [0×08] ·····

NUMBER OF 2ND CHORD CANDIDATES (4 BYTES) T2(0) (4 BYTES) [0×03] T2(1) (4 BYTES) [0×01] T2(2) (4 BYTES) [0×29] T2(3) (4 BYTES) [0×01] T2(4) (4 BYTES) [0×03] ·····

MUSICAL COMPOSITION DATA CREATION DEVICE AND METHOD

TECHNICAL FIELD

The present invention relates to an apparatus and a method for making data indicative of a music piece.

BACKGROUND ART

In Japanese Patent Publication Kokai No. Hei 5-289672, an apparatus is disclosed which recognizes chords of a music piece to make data representing the music piece as variations in the chords, i.e., as chord progression.

In accordance with music information previously notated (note information of sheet music), the apparatus disclosed in the publication determines a chord based on note components appearing at each beat or those that are obtained by eliminating notes indicative of non-harmonic sound from the note components, thereby making data representative of the chord progression of the music piece.

However, in the conventional music date making apparatus, music pieces with known beats of which chords can be analyzed are limited, and data indicative of chord progression from music sound with unknown beats can not be made.

Additionally, it is impossible for the conventional apparatus to analyze chords of a music piece from an audio signal indicative of the sound of the music piece in order to make data as chord progression.

DISCLOSURE OF INVENTION

The problems to be solved by the present invention include the aforementioned problem as one example. It is therefore an object of the present invention to provide an apparatus and a method for making music data, in which music chord progression are detected in accordance with an audio signal indicative of music sound to make data representative of the chord progression.

An apparatus for making music data according to the present invention, comprises: frequency conversion means for converting an input audio signal indicative of a music piece into a frequency signal indicative of magnitudes of frequency components at predetermined time intervals; component extraction means for extracting frequency components corresponding to tempered tones respectively at the predetermined time intervals from the frequency signal obtained by the frequency conversion means; chord candidate detecting means for detecting two chords each formed by a set of three frequency components as the first and second chord candidates, the three frequency components having a large total level of the frequency components corresponding to the tones extracted by the component extracting means; and smoothing means for smoothing trains of the first and second chord candidates repeatedly detected by the chord candidate detecting means to produce music data.

A method for making music data according to the present invention, comprises the steps of: converting an input audio signal indicative of a music piece into a frequency signal indicative of magnitudes of frequency components at predetermined time intervals; extracting frequency components corresponding to tempered tones respectively at the predetermined time intervals from the frequency signal; detecting two chords each formed by a set of three frequency components as the first and second chord candidates, the three frequency components having a large total level of the frequency components corresponding to the extracted tones; and smoothing trains of the respective detected first and second chord candidates to produce music data.

A computer-readable program according to the present invention, which is adapted to execute a method for making music data in accordance with an input audio signal indicative of a music piece, comprises: a frequency conversion step for converting the input audio signal into a frequency signal indicative of magnitudes of frequency components at predetermined time intervals; a component extraction step for extracting frequency components corresponding to tempered tones respectively at the predetermined time intervals from the frequency signal obtained in the frequency conversion step; a chord candidate detecting step for detecting two chords each formed by a set of three frequency components as the first and second chord candidates, the three frequency components having a large total level of the frequency components corresponding to the tones extracted in the component extracting step; and a smoothing step for smoothing trains of the first and second chord candidates repeatedly detected in the chord candidate detecting step to produce music data.

BRIEF DESCRIPTION OF DRAWINGS

FIG. 3 is a table of ratios of the frequencies of twelve tones and tone A one octave higher with reference to the lower tone A as 1.0;

FIG. 4 is a flow chart showing a main process in chord analysis operation;

FIG. 7 shows how a chord with four tones is transformed into a chord with three tones;

FIG. 8 shows a recording format into a temporary memory;

FIGS. 9A to 9C show method for expressing fundamental notes of chords, their attributes, and a chord candidate;

FIGS. 14A to 14D show how chord progression music data is produced and its format;

DETAILED DESCRIPTION OF THE INVENTION

Hereinafter, embodiments of the present invention will be described in detail with reference to the drawings.

Figure 1:
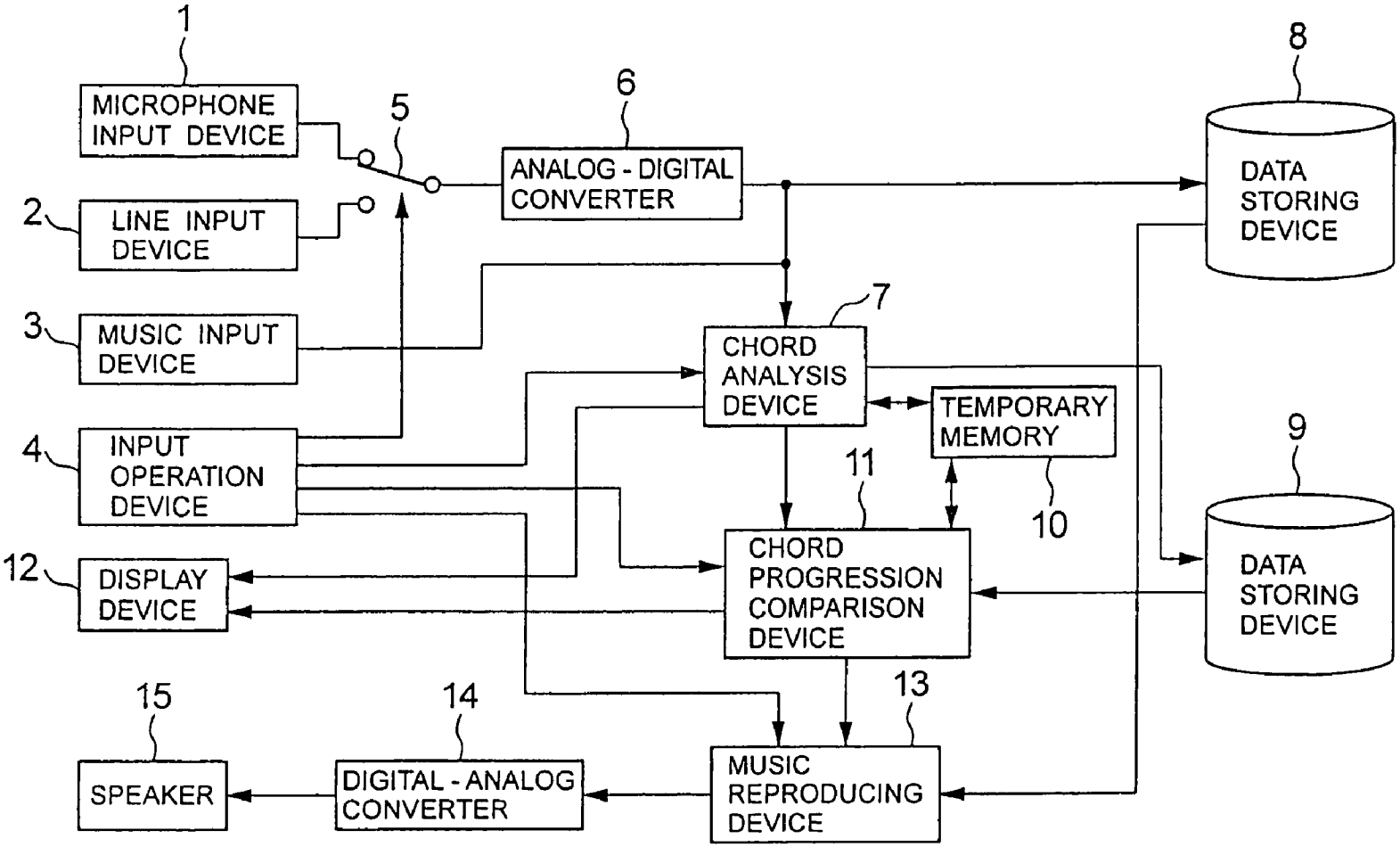
FIG. 1 is a block diagram of the configuration of a music processing system to which the invention is applied.

FIG. 1 shows a music processing system to which the present invention is applied. The music processing system includes a microphone input device 1, a line input device 2, a music input device 3, an input operation device 4, an input selector switch 5, an analog-digital converter 6, a chord analysis device 7, data storing devices 8 and 9, a temporary memory 10, a chord progression comparison device 11, a display device 12, a music reproducing device 13, a digital-analog converter 14, and a speaker 15.

The microphone input device 1 can collect a music sound with a microphone and outputs an analog audio signal representing the collected music sound. The line input device 2 is connected, for example, with a disc player or a tape recorder, so that an analog audio signal representing a music sound can be input. The music input device 3 is, for example, a CD player connected with the chord analysis device 7 and the data storing device 8 to reproduce a digitized audio signal (such as PCM data). The input operation device 4 is a device for a user to operate for inputting data or commands to the system. The output of the input operation device 4 is connected with the input selector switch 5, the chord analysis device 7, the chord progression comparison device 11, and the music reproducing device 13.

The input selector switch 5 selectively supplies one of the output signals from the microphone input device 1 and the line input device 2 to the analog-digital converter 6. The input selector switch 5 operates in response to a command from the input operation device 4.

The analog-digital converter 6 is connected with the chord analysis device 7 and the data storing device 8, digitizes an analog audio signal, and supplies the digitized audio signal to the data storing device 8 as music data. The data storing device 8 stores the music data (PCM data) supplied from the analog-digital converter 6 and the music input device 3 as files.

The chord analysis device 7 analyzes chords in accordance with the supplied music data by executing a chord analysis operation that will be described. The chords of the music data analyzed by the chord analysis device 7 are temporarily stored as first and second chord candidates in the temporary memory 10. The data storing device 9 stores chord progression music data (first chord progression music data), which is analyzed result by the chord analysis device 7, as a file for each music piece.

The chord progression comparison device 11 compares the chord progression music data (second chord progression music data) as an object of search and the chord progression music data stored in the data storing device 9, and chord progression music data with high similarities to the chord progression music data of the search object is detected. The display device 12 displays a result of the comparison by the chord progression comparison device 11 as a list of music pieces.

The music reproducing device 13 reads out the data file of the music piece detected as showing the highest similarity by the chord progression comparison device 11 from the data storing device 8, reproduces the data, and outputs as a digital audio signal. The digital-analog converter 14 converts the digital audio signal reproduced by the music reproducing device 13 into an analog audio signal.

The chord analysis device 7, the chord progression comparison device 11, and the music reproducing device 13 each operate in response to a command from the input operation device 4.

The operation of the music processing system will be described in detail below.

Here, assuming that an analog audio signal representing a music sound is supplied from the line input device 2 to the analog-digital converter 6 through the input selector switch 5, and then converted into a digital signal for supply to the chord analysis device 7, the operation is described.

The chord analysis operation includes a pre-process, a main process, and a post-process. The chord analysis device 7 carries out frequency error detection operation as the pre-process.

Figure 2:
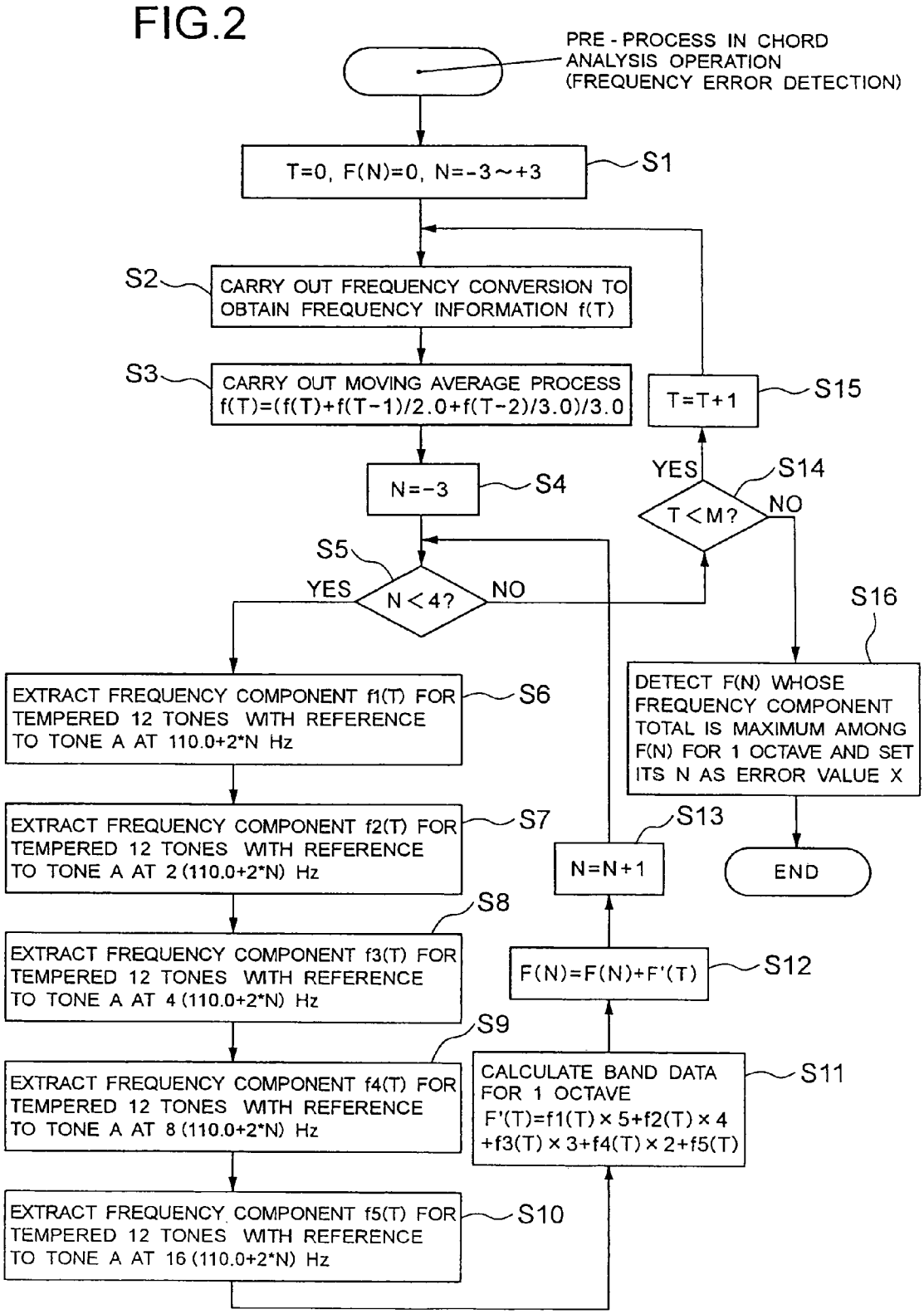
FIG. 2 is a flow chart showing the operation of frequency error detection.

In the frequency error detection operation, as shown in FIG. 2, a time variable T and a band data F(N) each are initialized to zero, and a variable N is initialized, for example, to the range from −3 to 3 (step S1). An input digital signal is subjected to frequency conversion by Fourier transform at intervals of 0.2 seconds, and as a result of the frequency conversion, frequency information f(T) is obtained (step S2).

The present information f(T), previous information f(T−1), and information f(T−2) obtained two times before are used to carry out a moving average process (step S3). In the moving average process, frequency information obtained in two operations in the past are used on the assumption that a chord hardly changes within 0.6 seconds. The moving average process is carried out by the following expression:

$$f(T)=(f(T)+f(T-1)/2.0+f(T-2)/3.0)/3.0 \quad (1)$$

After step S3, the variable N is set to −3 (step S4), and it is determined whether or not the variable N is smaller than 4 (step S5). If N<4, frequency components f1(T) to f5(T) are extracted from the frequency information f(T) after the moving average process (steps S6 to S10). The frequency components f1(T) to f5(T) are in tempered twelve tone scales for five octaves based on 110.0+2×N Hz as the fundamental frequency. The twelve tones are A, A#, B, C, C#, D, D#, E, F, F#, G, and G#. FIG. 3 shows frequency ratios of the twelve tones and tone A one octave higher with reference to the lower tone A as 1.0. Tone A is at 110.0+2×N Hz for f1(T) in step S6, at 2×(110.0+2×N) Hz for f2(T) in step S7, at 4×(110.0+2×N) Hz for f3(T) in step S8, at 8×(110.0+2×N) Hz for f4(T) in step S9, and at 16×(110.0+2×N) Hz for f5(T) in step 10.

After steps S6 to S10, the frequency components f1(T) to f5(T) are converted into band data F'(T) for one octave (step S11). The band data F'(T) is expressed as follows:

$$F'(T)=f1(T)\times 5+f2(T)\times 4+f3(T)\times 3+f4(T)\times 2+f5(T) \quad (2)$$

More specifically, the frequency components f1(T) to f5(T) are respectively weighted and then added to each other. The band data F'(T) for one octave is added to the band data F(N) (step S12). Then, one is added to the variable N (step S13), and step S5 is again carried out.

The operations in steps S6 to S13 are repeated as long as N<4 stands in step S5, in other words, as long as N is in the range from −3 to +3. Consequently, the tone component F(N) is a frequency component for one octave including tone interval errors in the range from −3 to +3.

If N≧4 in step S5, it is determined whether or not the variable T is smaller than a predetermined value M (step S14). If T<M, one is added to the variable T (step S15), and step S2 is again carried out. Band data F(N) for each variable N for frequency information f(T) by M frequency conversion operations is produced.

If T≧M in step S14, in the band data F(N) for one octave for each variable N, F(N) having the frequency components whose total is maximum is detected, and N in the detected F(N) is set as an error value X (step S16).

In the case of existing a certain difference between the tone intervals of an entire music sound such as a performance sound by an orchestra, the tone intervals can be compensated by obtaining the error value X by the pre-process, and the following main process for analyzing chords can be carried out accordingly.

Once the operation of detecting frequency errors in the pre-process ends, the main process for analyzing chords is carried out. Note that if the error value X is available in advance or the error is insignificant enough to be ignored, the pre-process can be omitted. In the main process, chord analysis is carried out from start to finish for a music piece, and therefore an input digital signal is supplied to the chord analysis device 7 from the starting part of the music piece.

As shown in FIG. 4, in the main process, frequency conversion by Fourier transform is carried out to the input digital signal at intervals of 0.2 seconds, and frequency information f(T) is obtained (step S21). This step S21 corresponds to a frequency converter. The present information f(T), the previous information f(T−1), and the information f(T−2) obtained two times before are used to carry out moving average process (step S22). The steps S21 and S22 are carried out in the same manner as steps S2 and S3 as described above.

After step S22, frequency components f1(T) to f5(T) are extracted from frequency information f(T) after the moving average process (steps S23 to S27). Similarly to the above described steps S6 to S10, the frequency components f1(T) to f5(T) are in the tempered twelve tone scales for five octaves based on 110.0+2×N Hz as the fundamental frequency. The twelve tones are A, A#, B, C, C#, D, D#, E, F, F#, G, and G#. Tone A is at 110.0+2×N Hz for f1(T) in step S23, at 2×(110.0+2×N) Hz for f2(T) in step S24, at 4×(110.0+2×N) Hz for f3(T) in step S25, at 8×(110.0+2×N) Hz for f4(T) in step S26, and at 16×(110.0+2×N) Hz for f5(T) in step 27. Here, N is X set in step S16.

After steps S23 to S27, the frequency components f1(T) to f5(T) are converted into band data F'(T) for one octave (step S28). The operation in step S28 is carried out using the expression (2) in the same manner as step S11 described above. The band data F'(T) includes tone components. These steps S23 to S28 correspond to a component extractor.

After step S28, the six tones having the largest intensity levels among the tone components in the band data F'(T) are selected as candidates (step S29), and two chords M1 and M2 of the six candidates are produced (step S30). One of the six candidate tones is used as a root to produce a chord with three tones. More specifically, ${}_6C_3$ chords are considered. The levels of three tones forming each chord are added. The chord whose addition result value is the largest is set as the first chord candidate M1, and the chord having the second largest addition result is set as the second chord candidate M2.

Figure 5:
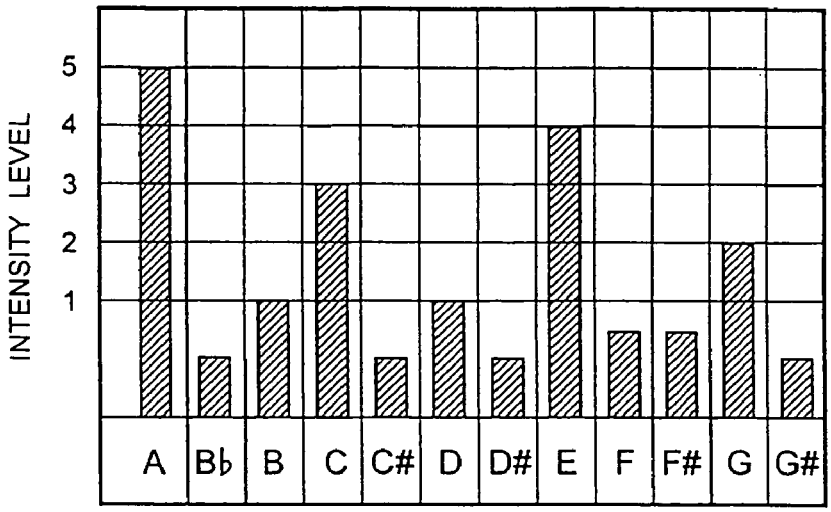
FIG. 5 is a graph showing one example of the intensity levels of tone components in band data.

When the tone components of the band data F'(T) show the intensity levels for twelve tones as shown in FIG. 5, six tones, A, E, C, G, B, and D are selected in step S29. Triads each having three tones from these six tones A, E, C, G, B, and D are chord Am (of tones A, C, and E), chord C (of tones C, E, and G), chord Em (of tones E, B, and G), chord G (of tones G, B, and D), . . . The total intensity levels of chord Am (A, C, E), chord C (C, E, G), chord Em (E, B, G), and chord G (G, B, D) are 12, 9, 7, and 4, respectively. Consequently, in step S30, chord Am whose total intensity level is the largest, i.e., 12 is set as the first chord candidate M1. Chord C whose total intensity level is the second largest, i.e., 7 is set as the second chord candidate M2.

Figure 6:
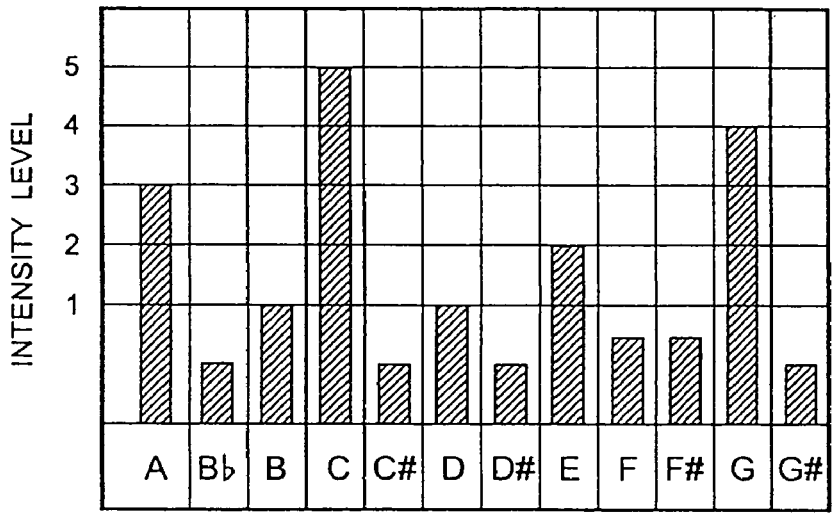
FIG. 6 is a graph showing another example of the intensity levels of tone components in band data.

When the tone components in the band data F'(T) show the intensity levels for the twelve tones as shown in FIG. 6, six tones C, G, A, E, B, and D are selected in step S29. Triads produced from three tones selected from these six tones C, G, A, E, B, and D are chord C (of tones C, E, and G), chord Am (of A, C, and E), chord Em (of E, B, and G), chord G (of G, B, and D), . . . . The total intensity levels of chord C (C, E, G), chord Am (A, C, E), chord Em (E, B, G), and chord G (G, B, D) are 11, 10, 7, and 6, respectively. Consequently, chord C whose total intensity level is the largest, i.e., 11 in step S30 is set as the first chord candidate M1. Chord Am whose total intensity level is the second largest, i.e., 10 is set as the second chord candidate M2.

The number of tones forming a chord does not have to be three, and there is, for example, a chord with four tones such as 7th and diminished 7th. Chords with four tones are divided into two or more chords each having three tones as shown in FIG. 7. Therefore, similarly to the above chords of three tones, two chord candidates can be set for these chords of four tones in accordance with the intensity levels of the tone components in the band data F'(T).

After step S30, it is determined whether or not there are chords as many as the number set in step S30 (step S31). If the difference in the intensity level is not large enough to select at least three tones in step 30, no chord candidate is set. This is why step S31 is carried out. If the number of chord candidates >0, it is then determined whether the number of chord candidates is greater than one (step S32).

If it is determined in step S31 that the number of chord candidates=0, the chord candidates M1 and M2 set in the previous main process at T−1 (about 0.2 seconds before) are set as the present chord candidates M1 and M2 (step S33). If the number of chord candidates=1 in step S32, it means that only the first candidate M1 has been set in the present step S30, and. therefore the second chord candidate M2 is set as the same chord as the first chord candidate M1 (step S34). These steps S29 to S34 correspond to a chord candidate detector.

If it is determined that the number of chord candidates>1 in step S32, it means that both the first and second chord candidates M1 and M2 are set in the present step S30, and therefore, time, and the first and second chord candidates M1 and M2 are stored in the temporary memory 10 (step S35). The time and first and second chord candidates M1 and M2 are stored as a set in the temporary memory 10 as shown in FIG. 8. The time is the number of how many times the main process is carried out and represented by T incremented for each 0.2 seconds. The first and second chord candidates M1 and M2 are stored in the order of T.

More specifically, a combination of a fundamental tone (root) and its attribute is used in order to store each chord candidate on a 1-byte basis in the temporary memory 10 as shown in FIG. 8. The fundamental tone indicates one of the tempered twelve tones, and the attribute indicates a type of chord such as major {4, 3}, minor {3, 4}, 7th candidate {4, 6}, and diminished 7th (dim7) candidate {3, 3}. The numbers in the braces { } represent the difference among three tones when a semitone is 1. A typical candidate for 7th is {4, 3, 3}, and a typical diminished 7th (dim7) candidate is {3, 3, 3}, but the above expression is employed in order to express them with three tones.

As shown in FIG. 9A, the 12 fundamental tones are each expressed on a 16-bit basis (in hexadecimal notation). As shown in FIG. 9B, each attribute, which indicates a chord type, is represented on a 16-bit basis (in hexadecimal notation). The lower order four bits of a fundamental tone and the lower order four bits of its attribute are combined in that order, and used as a chord candidate in the form of eight bits (one byte) as shown in FIG. 9C.

Step S35 is also carried out immediately after step S33 or S34 is carried out.

After step S35 is carried out, it is determined whether the music has ended (step S36). If, for example, there is no longer an input analog audio signal, or if there is an input operation indicating the end of the music from the input operation device 4, it is determined that the music has ended. The main process ends accordingly.

Until the end of the music is determined, one is added to the variable T (step S37), and step S21 is carried out again. Step S21 is carried out at intervals of 0.2 seconds, in other words, the process is carried out again after 0.2 seconds from the previous execution of the process.

Figure 10:
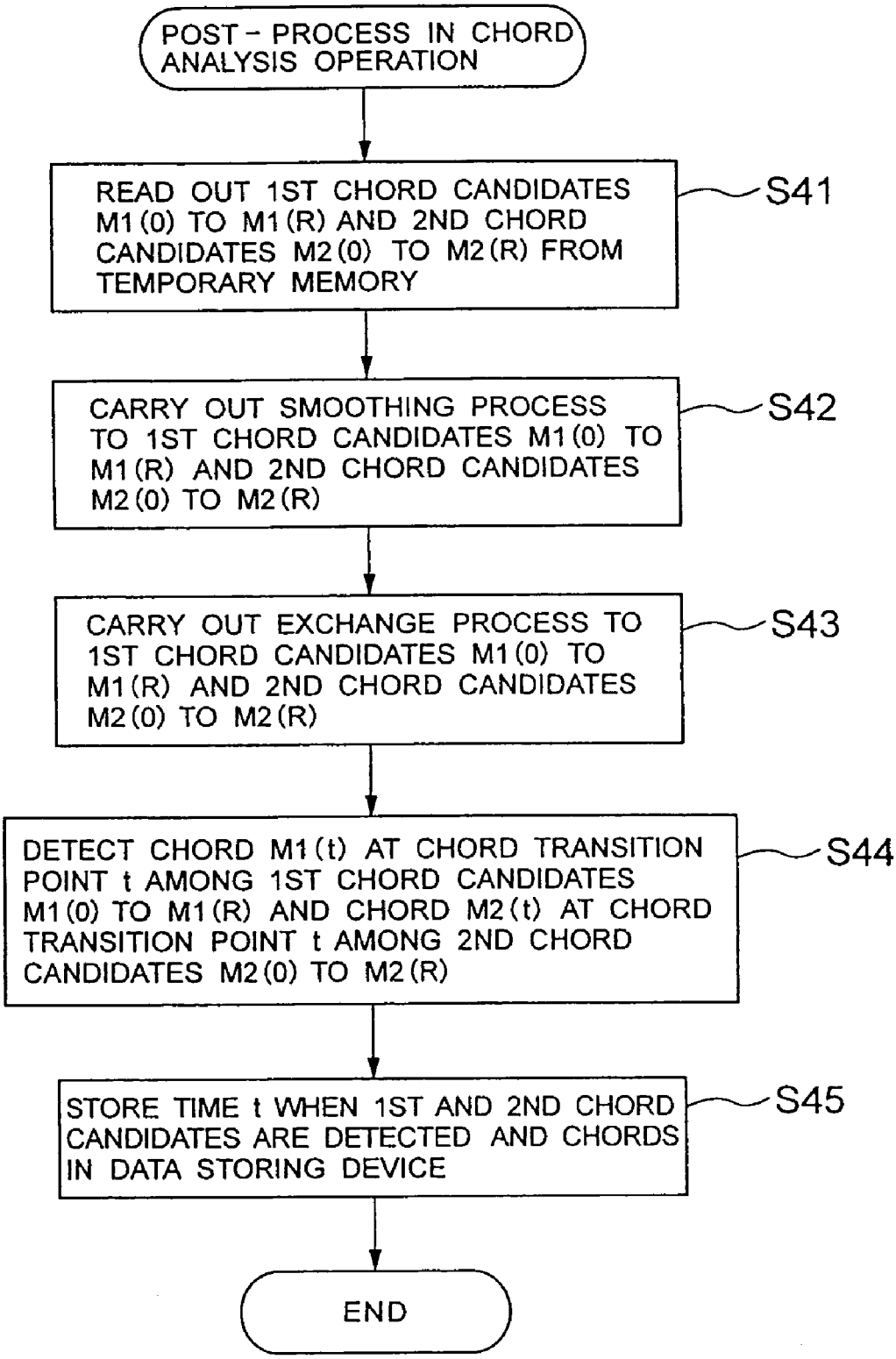
FIG. 10 is a flow chart showing a post-process in chord analysis operation.

In the post-process, as shown in FIG. 10, all the first and second chord candidates M1(0) to M1(R) and M2(0) to M2(R) are read out from the temporary memory 10 (step S41). Zero represents the starting point and the first and second chord candidates at the starting point are M1(0) and M2(0). The letter R represents the ending point and the first and second chord candidates at the ending point are M1(R) and M2(R). These first chord candidates M1(0) to M1(R) and the second chord candidates M2(0) to M2(R) thus read out are subjected to smoothing (step S42). The smoothing is carried out to cancel errors caused by noise included in the chord candidates when the candidates are detected at the intervals of 0.2 seconds regardless of transition points of the chords. As a specific method of smoothing, it is determined whether or not a relation represented by M1(t−1)≠M1(t) and M1(t)≠M1(t+1) stand for three consecutive first chord candidates M1(t−1), M1(t) and M1(t+1). If the relation is established, M1(t) is equalized to M1(t+1). The determination process is carried out for each of the first chord candidates. Smoothing is carried out to the second chord candidates in the same manner. Note that rather than equalizing M1(t) to M1(t+1), M1(t+1) may be equalized to M1(t).

After the smoothing, the first and second chord candidates are exchanged (step S43). There is little possibility that a chord changes in a period as short as 0.6 seconds. However, the frequency characteristic of the signal input stage and noise at the time of signal input can cause the frequency of each tone component in the band data F'(T) to fluctuate, so that the first and second chord candidates can be exchanged within 0.6 seconds. Step S43 is carried out as a remedy for the possibility. As a specific method of exchanging the first and second chord candidates, the following determination is carried out for five consecutive first chord candidates M1(t−2), M1(t−1), M1(t), M1(t+1), and M1(t+2) and five second consecutive chord candidates M2(t−2), M2(t−1), M2(t), M2(t+1), and M2(t+2) corresponding to the first candidates. More specifically, it is determined whether a relation represented by M1(t−2)=M1(t+2), M2(t−2)=M2(t+2), M1(t−1)=M1(t)=M1(t+1)=M2(t−2), and M2(t−1)=M2(t)=M2(t+1)=M1(t−2) is established. If the relation is established, M1(t−1)=M1(t)=M1(t+1)=M1(t−2) and M2(t−1)=M2(t)=M2(t+1)=M2(t−2) are determined, and the chords are exchanged between M1(t−2) and M2(t−2). Note that chords may be exchanged between M1(t+2) and M2(t+2) instead of between M1(t−2) and M2(t−2). It is also determined whether or not a relation represented by M1(t−2)=M1(t+1), M2(t−2)=M2(t+1), M1(t−1)=M(t)=M1(t+1)=M2(t−2) and M2(t−1)=M2(t)=M2(t+1)=M1(t−2) is established. If the relation is established, M1(t−1)=M(t)=M1(t−2) and M2(t−1)=M2(t)=M2(t−2) are determined, and the chords are exchanged between M1(t−2) and M2(t−2). The chords may be exchanged between M1(t+1) and M2(t+1) instead of between M1(t−2) and M2(t−2).

Figure 11:
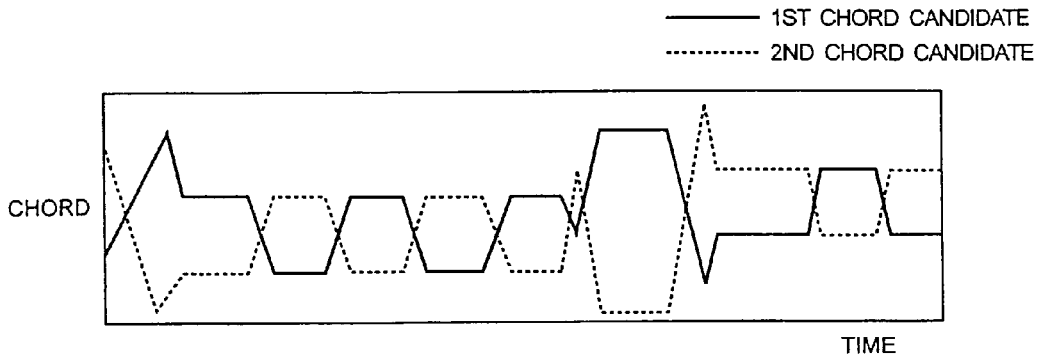
FIG. 11 shows chronological changes in first and second chord candidates before a smoothing process.
Figure 12:
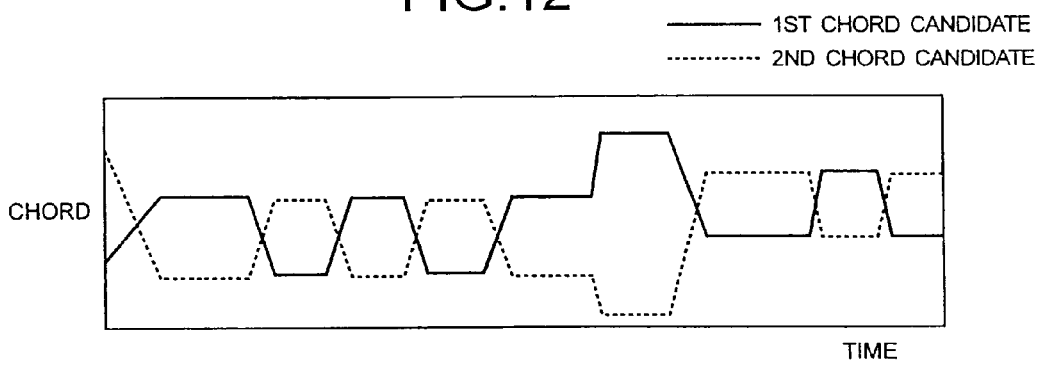
FIG. 12 shows chronological changes in first and second chord candidates after the smoothing process.
Figure 13:
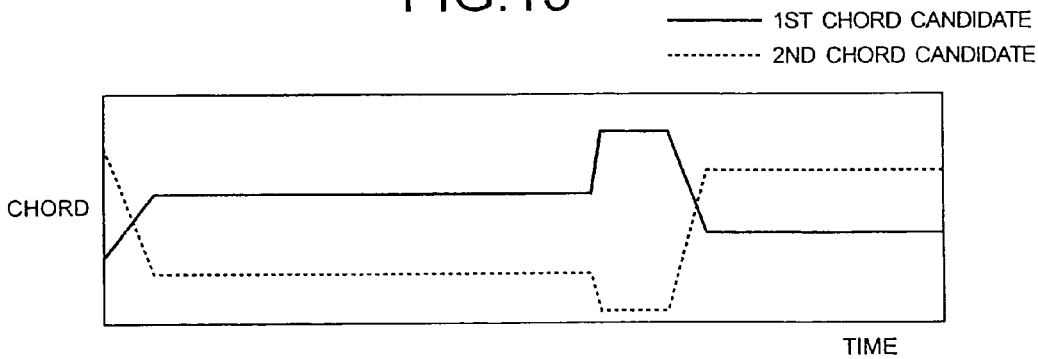
FIG. 13 shows chronological changes in first and second chord candidates after an exchanging process.

The first chord candidates M1(0) to M1(R) and the second chord candidates M2(0) to M2(R) read out in step S41, for example, change with time as shown in FIG. 11, the averaging in step S42 is carried out to obtain a corrected result as shown in FIG. 12. In addition, the chord exchange in step S43 corrects the fluctuations of the first and second chord candidates as shown in FIG. 13. Note that FIGS. 11 to 13 show changes in the chords by a line graph in which positions on the vertical line correspond to the kinds of chords.

The candidate M1(t) at a chord transition point t of the first chord candidates M1(0) to M1(R) and M2(t) at the chord transition point t of the second chord candidates M2(0) to M2(R) after the chord exchange in step S43 are detected (step S44), and the detection point t (4 bytes) and the chord (4 bytes) are stored for each of the first and second chord candidates in the data storing device 9 (step S45). Data for one music piece stored in step S45 is chord progression music data. These steps S41 to S45 correspond to a smoothing device.

When the first and second chord candidates M1(0) to M1(R) and M2(0) to M2(R), after exchanging the chords in step S43, fluctuate with time as shown in FIG. 14A, the time and chords at transition points are extracted as data. FIG. 14B shows the content of data at transition points among the first chord candidates F, G, D, Bb (B flat), and F that are expressed as hexadecimal data 0×08, 0×0A, 0×05, 0×01, and 0×08. The transition points t are T1(0), T1(1), T1(2), T1(3), and T1(4). FIG. 14C shows data contents at transition points among the second chord candidates C, Bb, F#m, Bb, and C that are expressed as hexadecimal data 0×03, 0×01, 0×29, 0×01, and 0×03. The transition points t are T2(0), T2(1), T2(2), T2(3), and T2(4). The data contents shown in FIGS. 14B and 14C are stored together with the identification information of the music piece in the data storing device 9 in step S45 as a file in the form as shown in FIG. 14D.

The chord analysis operation as described above is repeated for analog-audio signals representing different music sounds. In this way, chord progression music data is stored in the data storing device 9 as a file for each of the plurality of music pieces. The above described chord analysis operation is carried out for a digital audio signal representing music sound supplied from the music input device 3, and chord progression music data is stored in the data storing device 9. Note that music data of PCM signals corresponding to the chord progression music data in the data storing device 9 is stored in the data storing device 8.

In step S44, a first chord candidate at a chord transition point of the first chord candidates and a second chord candidate at a chord transition point of the second chord candidates are detected. Then, the detected candidates form final chord progression music data, therefore the capacity per music piece can be reduced even as compared to compression data such as MP3, and data for each music piece can be processed at high speed.

The chord progression music data written in the data storing device 9 is chord data temporally in synchronization with the actual music. Therefore, when the chords are actually reproduced by the music reproducing device 13 using only the first chord candidate or the logical sum output of the first and second chord candidates, the accompaniment can be played to the music.

Figure 15:
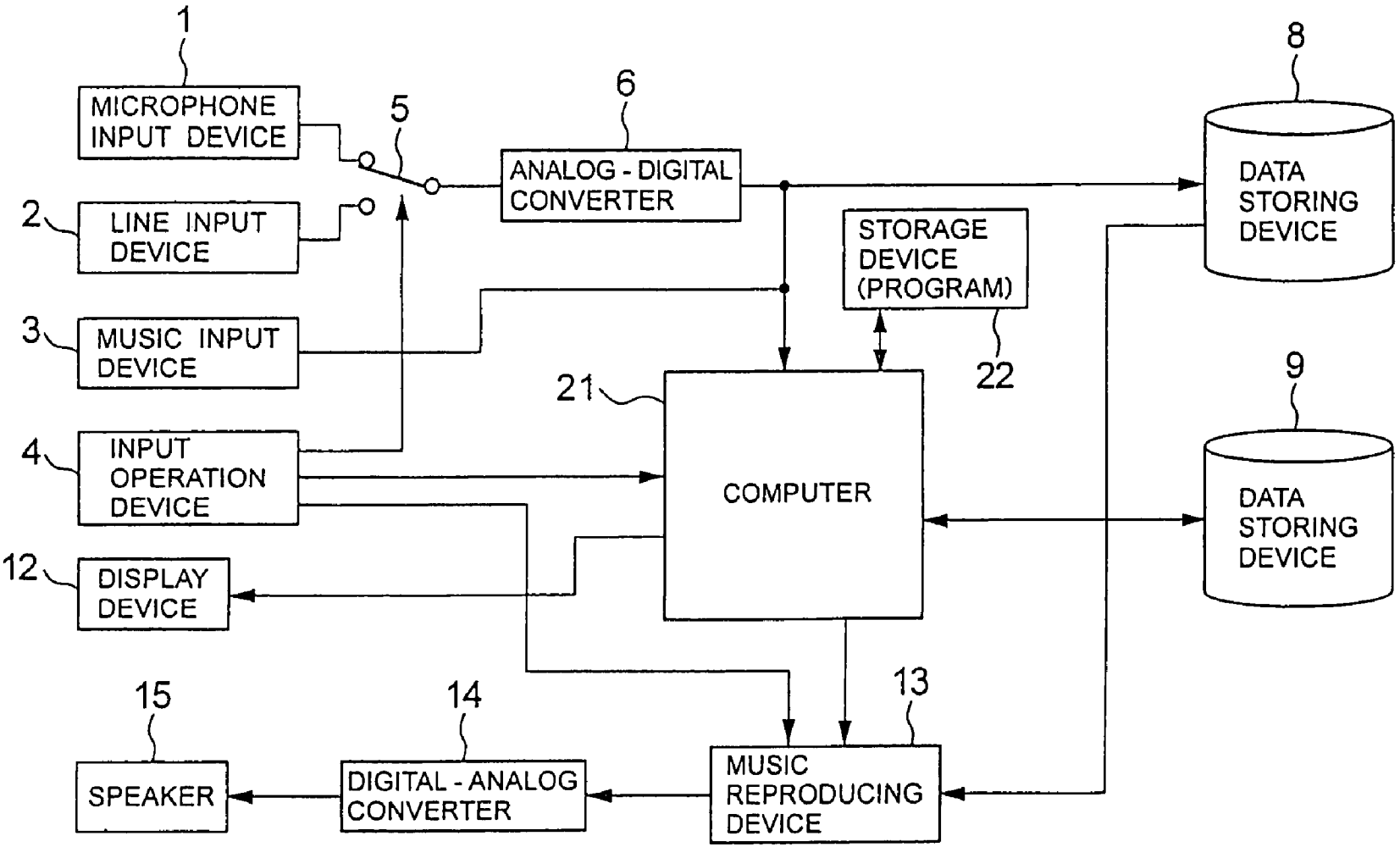
FIG. 15 is a block diagram of the configuration of a music processing system as another embodiment of the invention.

FIG. 15 shows another embodiment of the invention. In the music processing system in FIG. 15, the chord analysis device 7, the temporary memory 10, and the chord progression comparison device 11 in the system in FIG. 1 are formed by a computer 21. The computer 21 carries out the above-described chord analysis operation and music searching operation according to programs stored in the storage device 22. The storage device 22 does not have to be a hard disk drive and may be a drive for a storage medium. In the case, chord progression music data may be written in the storage medium.

As described above, the present invention includes frequency conversion means, component extraction means, chord candidate detection means, and smoothing means. Therefore, the chord progression of a music piece can be detected in accordance with an audio signal representing the sound of the music piece, and as a result, data characterized by the chord progression can be easily obtained.

The invention claimed is:

1. An apparatus for making music data comprising:

frequency conversion means for converting an input audio signal indicative of a music piece into a frequency signal indicative of magnitudes of frequency components at predetermined time intervals;

component extraction means for extracting frequency components corresponding to tempered tones respectively at the predetermined time intervals from the frequency signal obtained by said frequency conversion means;

chord candidate detecting means for detecting two chords each formed by a set of three frequency components as said first and second chord candidates, said three frequency components having the largest total level of the frequency components corresponding to the tones extracted by said component extracting means; and smoothing means for smoothing trains of said first and second chord candidates repeatedly detected by said chord candidate detecting means to produce music data.

2. The apparatus for making music data according to claim 1, wherein said frequency conversion means performs a moving average process on the frequency signal for output.

3. The apparatus for making music data according to claim 1, wherein said component extraction means comprises:

filter means for extracting each frequency component corresponding to each of the tempered tones of a plurality of octaves; and means for individually weighting and adding together levels of frequency components each corresponding to each of the tempered tones of each octave output from said filter means to output the frequency components corresponding to the respective tempered tones of one octave.

4. The apparatus for making music data according to claim 1, further comprising frequency error detection means for detecting a frequency error in a frequency component corresponding to each of the tempered tones of the input audio signal, wherein said component extraction means adds the frequency error to a frequency of each of the tempered tones for compensation, and extracts a frequency component after having been compensated.

5. The apparatus for making music data according to claim 4, said frequency error detection means includes:

second frequency conversion means for converting the input audio signal at predetermined time intervals into a frequency signal indicative of magnitudes of frequency components;

means for designating one of a plurality of frequency errors each time said second frequency conversion means performs the frequency conversion by a predetermined number of times;

filter means for extracting each frequency component having a frequency corresponding to each of the tempered tones of a plurality of octaves and the one frequency error;

means for individually weighting and adding together levels of frequency components corresponding to each of the tempered tones of each octave output from said filter means to output a frequency component corresponding to each of the tempered tones of one octave; and adding means for calculating a sum of levels of each frequency components of the one octave for each of the plurality of frequency errors, wherein a frequency error having a maximum level provided by said adding means is employed as a detected frequency error.

6. The apparatus for making music data according to claim 1, wherein said chord candidate detection means defines a chord formed by a set of three frequency components having a maximum value of the total level as the first chord candidate, and a chord formed by a set of three frequency components having a second maximum value of the total level as the second chord candidate.

7. The apparatus for making music data according to claim 1, wherein said smoothing means modifies contents of the first chord candidate or the second chord candidate such that a predetermined number of consecutive first chord candidates in the train of the first chord candidates are equal to each other and the predetermined number of consecutive second chord candidates in the train of the second chord candidates are equal to each other.

8. The apparatus for making music data according to claim 1, wherein said smoothing means provides only a chord candidate at a time point of chord change in each train of the first and second chord candidates.

9. The apparatus for making music data according to claim 1, wherein said smoothing means includes error eliminating means, when of three consecutive first chord candidates in the train of the first chord candidates, the beginning first chord candidate is not equal to the middle first chord candidate and the middle first chord candidate is not equal to the ending first chord candidate, for making the middle first chord candidate equal to the beginning first chord candidate or the ending first chord candidate, and when of three consecutive second chord candidates in the train of the second chord candidates, the beginning second chord candidate is not equal to the middle second chord candidate and the middle second chord candidate is not equal to the ending second chord candidate, for making the middle second chord candidate equal to the beginning second chord candidate or the ending second chord candidate, and transposing means, when of five consecutive first chord candidates in the train of the first chord candidates and of five consecutive second chord candidates in the train of the second chord candidates, the first of the first chord candidates is equal to the fifth of the first chord candidates; the first of the second chord candidates is equal to the fifth of the second chord candidates; the second, the third, and the fourth of the first chord candidates and the fifth of the second chord candidates are equal to each other; and the second, the third, and the fourth of the second chord candidates and the fifth of the first chord candidates are equal to each other, for making the first of first chord candidates or the fifth of the first chord candidates equal to the second or the fourth of the first chord candidates and for making the first of second chord candidates or the fifth of the second chord candidates equal to the second through the fourth of the second chord candidates; and when of the first to the fourth of the consecutive first chord candidates in the train of the first chord candidates and of the first to the fourth of the consecutive second chord candidates in the train of the second chord candidates, the first of the first chord candidates is equal to the fourth of the first chord candidates; the first of the second chord candidates is equal to the fourth of the second chord candidates; the second of the first chord candidates, the third of the first chord candidates and the first of the second chord candidates are equal to each other; and the second of the second chord candidates, the third of the second chord candidates and the first of the first chord candidates are equal to each other, for making the first of the first chord candidates or the fourth of the first chord candidates equal to the second and the third of the first chord candidates and making the first of the second chord candidates or the fourth of the second chord candidates equal to the second and the third of the second chord candidates.

10. The apparatus for making music data according to claim 1, wherein the music data is indicative of a chord and a time point of chord change in each train of the first and second chord candidates.

11. A method for making music data comprising the steps of:

converting an input audio signal indicative of a music piece into a frequency signal indicative of magnitudes of frequency components at predetermined time intervals;

extracting frequency components corresponding to tempered tones respectively at the predetermined time intervals from the frequency signal;

detecting two chords each formed by a set of three frequency components as said first and second chord candidates, said three frequency components having the largest total level of the frequency components corresponding to the extracted tones; and smoothing trains of the respective detected first and second chord candidates to produce music data.

12. A program, stored on a computer-readable medium, adapted to execute a method for making music data in accordance with an input audio signal indicative of a music piece, the program comprising:

a frequency conversion step for converting the input audio signal into a frequency signal indicative of magnitudes of frequency components at predetermined time intervals;

a component extraction step for extracting frequency components corresponding to tempered tones respectively at the predetermined time intervals from the frequency signal obtained in said frequency conversion step;

a chord candidate detecting step for detecting two chords each formed by a set of three frequency components as said first and second chord candidates, said three frequency components having the largest total level of the frequency components corresponding to the tones extracted in said component extracting step; and a smoothing step for smoothing trains of said first and second chord candidates repeatedly detected in said chord candidate detecting step to produce music data.

* * * * *